US005627550A

United States Patent [19]

Sanad

[11] Patent Number: 5,627,550

[45] Date of Patent: May 6, 1997

[54] WIDEBAND DOUBLE C-PATCH ANTENNA INCLUDING GAP-COUPLED PARASITIC ELEMENTS

[75] Inventor: Mohamed Sanad, San Diego, Calif.

[73] Assignee: Nokia Mobile Phones Ltd., Salo, Finland

[21] Appl. No.: 490,641

[22] Filed: Jun. 15, 1995

[51] Int. Cl.[6] ..... H01Q 1/38; H01Q 13/10

[52] U.S. Cl. ..... 343/700 MS; 343/702; 343/767; 343/770; 343/818

[58] Field of Search ..... 343/700 MS, 702, 343/818, 846, 767, 770

[56] References Cited

U.S. PATENT DOCUMENTS

| | | | |
|---|---|---|---|
| 4,040,060 | 8/1977 | Kaloi | 343/700 MS |
| 4,072,951 | 2/1978 | Kaloi | 343/700 MS |
| 4,125,837 | 11/1978 | Kaloi | 343/700 MS |
| 4,138,684 | 2/1979 | Kerr | 343/846 |
| 4,291,312 | 9/1981 | Kaloi | 343/700 MS |
| 4,356,492 | 10/1982 | Kaloi | 343/700 MS |
| 4,590,478 | 5/1986 | Powers et al. | 343/700 MS |
| 4,812,855 | 3/1989 | Coe et al. | 343/700 MS |
| 4,980,694 | 12/1990 | Hines | 343/700 MS |
| 5,220,335 | 6/1993 | Huang | 343/700 MS |
| 5,420,596 | 5/1995 | Burrel et al. | 343/700 MS |

FOREIGN PATENT DOCUMENTS

| | | |
|---|---|---|
| 0176311A3 | 2/1986 | European Pat. Off. . |
| 0610025A1 | 10/1994 | European Pat. Off. . |
| 0630069A1 | 12/1994 | European Pat. Off. . |
| 0637094A1 | 1/1995 | European Pat. Off. . |
| 58-215807 | 12/1983 | Japan . |
| WO94/24723 | 10/1994 | WIPO . |
| WO94/24722 | 10/1994 | WIPO . |

OTHER PUBLICATIONS

Ninth International Conf. On Antennas & Prop., vol. 1, 4–7 Apr. 1995, Sanad: "A Very Small Double C–Patch Antenna Contained in a PCMCIA Standard PC Card", pp. 117–120.

IEEE Antennas & Propagation Society Int. Symposium 1994, vol. 2, 20–24 Jun. 1994, Sanad: "Microstrip Antennas on Very Small Ground Planes for Portable Communication Systems", pp. 810–812.

IEEE Transactions On Antennas & Propagation, vol. 38, No. 5, May 1990, Habashy et al.: "Input Impedance and Radiation Pattern of Cylindrical–Rectangular and Wraparound Microstrip Antennas", pp. 722–731.

Bahl et al. Microstrip Antennas, published by Artech House, Inc., Dedham, MA, 1980, pp. 4–6.

Luk et al., Patch Antennas on a Spherical Body, IEEE Proc. H, vol. 138, No. 1, Feb. ±991, pp. 103–108.

"Study of multilayer microstrip antennas with radiating elements of various geometry", J.P. Damiano, et al., IEE Proceedings, vol. 137, Pt.H. No. 3, Jun. 1990.

(List continued on next page.)

*Primary Examiner*—Donald T. Hajec
*Assistant Examiner*—Tan Ho
*Attorney, Agent, or Firm*—Perman & Green, LLP

[57] ABSTRACT

A wide bandwidth, shorted, dual C-patch antenna includes a truncated ground plane, a layer of dielectric material having a first surface overlying the ground plane and an opposing second surface, and an electrically conductive layer overlying the second opposing surface of the dielectric layer. The electrically conductive layer is differentiated into a plurality of antenna elements including a driven antenna element and at least one non-driven, parasitic antenna element. Each of the antenna elements is in the shape of a parallelogram and has one of a rectangular and a non-rectangular (e.g., parabolic, triangular, pentagonal) aperture having a length that extends along a first edge of the electrically conductive layer and a width that extends towards an oppositely disposed second edge. The length has a value that is equal to approximately 20% to approximately 35% of a length of the first edge. The antenna may further include electrically conductive vias or feedthroughs for shorting the electrically conductive layer to the ground plane at a region adjacent to a third edge of the electrically conductive layer. The wide bandwidth antenna may be curved about one or more axes.

30 Claims, 6 Drawing Sheets

OTHER PUBLICATIONS

"A New Stack Microstrip Antenna With Large Bandwidth And High Gain", H. Legay and L. Shafai, 1993 International Symposium Digest Antennas And Propagation, vol. 2.

"Nonradiating Edges and Four Edges Gap–Coupled Multiple Resonator Broad–Band Microstrip Antennas" 1985 IEEE vol. AP–33, No. 2 Feb., Girish Kumar and K. Gupta.

"Compact Broadband Microstrip Antenna", Electronics Letters, Jul. 14, 1986 C.K. Aanandan and K.G. Nair.

"Handbook of Microstrip Antennas" vol. 2 by JR James & PS Hall, P. Peregrinus Ltd., London, U.K. (1989) pp. 1092–1104.

"The C–Patch: A Small Microstrip Element", 15 Dec. 1988, G. Kossiavas, A. Papiernik, J.P. Boisset, and M. Sauvan.

WIDEBAND DOUBLE C-PATCH ANTENNA INCLUDING GAP-COUPLED PARASITIC ELEMENTS

CROSS-REFERENCE TO RELATED PATENT APPLICATIONS

This patent application is related to commonly assigned U.S. patent application Ser. No. 08/414,573, filed Mar. 31, 1995, entitled "A Small Double C-Patch Antenna Contained in a Standard PC Card", by Mohamed Sanad, and to commonly assigned U.S. patent application Ser. No. 08/490,771, filed on even date herewith, entitled "Planar and Non-Planar Double C-Patch Antennas Having Different Aperture Shapes", by Mohamed Sanad (attorney's docket no. 365-955930-NA).

FIELD OF THE INVENTION

This invention relates generally to microstrip antenna structures and, in particular, to a C-patch antenna structure.

BACKGROUND OF THE INVENTION:

In an article entitled "The C-Patch: A Small Microstrip Element", 15 Dec. 1988, G. Kossiavas, A Papiernik, J. P. Boisset, and M. Sauvan describe a radiating element that operates in the UHF and L-bands. The dimensions of the C-patch are smaller than those of conventional square or circular elements operating at the same frequency, which are relatively bulky. In general, the dimensions of any radiating element are inversely proportional to the resonant frequency. Referring to FIG. 1, a substantially square electrically conductive radiating element or patch 5 (operating at 413 MHz) has an aperture that extends part way across the patch. The width (d) of the aperture (12.5 mm) is shown to be 20% of the total width (L=W=62.5 mm) of the patch, while for an example operating at 1.38 GHz (L-band) the width (d) of the aperture (5.5 mm) is approximately 16.7% of the width (L=22 mm, W=33 mm) of the patch. This antenna geometry is shown to exhibit a threefold to fourfold gain in area with respect to conventional square or circular antennas, although the bandwidth is somewhat narrower. Good impedance matching with a coaxial feed is shown to be a feature of the C-patch antenna, as is an omnidirectional radiation pattern with linear polarization.

In general, microstrip antennas are known for their advantages in terms of light weight, flat profiles, low manufacturing cost, and compatibility with integrated circuits. The most commonly used microstrip antennas are the conventional half-wavelength and quarter-wavelength rectangular patch antennas. Other microstrip antenna configurations have been studied and reported in the literature, such as circular patches, triangular patches, ring microstrip antennas, and the above-mentioned C-patch antennas.

In the "Handbook of Microstrip Antennas", Volume 2, Ch. 19, Ed. by J. R. James and P. S. Hall, P. Peregrinus Ltd., London, U.K. (1989), pgs. 1092–1104, a discussion is made of the use of microstrip antennas for hand-held portable equipment. A window-reactance-loaded microstrip antenna (WMSA) is described at pages 1099 and is illustrated in FIGS. 19.33–19.36. A narrow reactance window or slit is placed on the patch to reduce the patch length as compared to a quarter-wavelength microstrip antenna (QMSA). The value of the reactance component is varied by varying the width (along the long axis) of the slit. FIG. 19.36*a* shows the use of two collinear narrow slits that form a reactance component in the antenna structure, enabling the length of the radiation patch to be shortened.

The narrow slit does not function as a radiating element, and is thus not equivalent in function to the substantially larger aperture in the above-described C-patch antenna.

So-called PC cards are small form-factor adapters for personal computers, personal communicators, or other electronic devices. As is shown in FIG. 7, a PC card 1 is comparable in size and shape to a conventional credit card, and can be used with a portable computer system 2 that is equipped with an interface 3 that is physically and electrically compatible with a standard promulgated by the Personal Computer Memory Card International Association (PCMCIA). Reference in this regard can be made to Greenup, J. 1992, "PCMCIA 2.0 Contains Support for I/O Cards, Peripheral Expansion", *Computer Technology Review, USA,* 43–48.

PC cards provide the flexibility of adding features after the base computer system has been purchased. It is possible to install and remove PCMCIA PC cards without powering off the system or opening the covers of the personal computer system unit.

The PC card 1 has standard PCMCIA dimensions of 8.56 cm×5.4 cm. The thickness of the PCMCIA card 1 varies as a function of type. A Type II PCMCIA PC card is defined to have a thickness of 0.5 cm. The Type II PCMCIA PC card can be used for memory enhancement and/or I/O features, such as wireless modems, pagers, LANs, and host communications.

Such a PC card can also provide wireless communication capability to laptop, notebook, and palmtop personal computers, and any other computer system having a PCMCIA-compatible interface. The PC card may also work as a standalone wireless communication card when it is not connected to a computer.

For such applications it is required to provide the PC card with a small, built-in antenna having a wide bandwidth isotropic radiation pattern. Since the PCMCIA wireless communication card may be hand-held and/or used in an operator's pocket, the antenna should be substantially immune from effects caused by the close proximity of the human body. Furthermore, the portable PCMCIA communication cards are typically randomly orientated during use and, thus, suffer from multipath reflections and rotation of polarization. Therefore, the antenna should be sensitive to both vertically and horizontally polarized waves. Moreover, the antenna should preferably exhibit the same resonant frequency, input impedance, and radiation patterns when used in free space and when used inside a PCMCIA Type II slot in a conventional portable computer.

It can be appreciated the design of an antenna that meets these various requirements, including a wide bandwidth, presents a significant challenge.

Furthermore, there is a growing interest in developing efficient internal integrated antennas for the class of 900 MHz digital cordless telephones. A high performance built-in antenna is required to have a very small size, a compact structure, a wide bandwidth, a quasi-isotropic radiation pattern, and to exhibit a negligible susceptibility to the proximity of the human body. Furthermore, since portable cordless telephones are normally randomly orientated during use, their antennas must be sensitive to both vertically and horizontally polarized waves. External antennas, such as the whip, sleeve dipole, and helical, are sensitive only to one polarization of the radio waves. As a result, they are not optimized for use with the portable cordless telephones in which antenna orientation is not fixed. Moreover, it has been found that when such external antennas are operated in close proximity to a user of the phone, their radiation patterns change significantly. In addition, a significant portion of the radiated power is attenuated by the user's body.

The microstrip antenna is one of the most preferable types for small portable cordless telephones, especially when a built-in antenna is required. Since the microstrip antenna can be made with a very thin and compact structure, it can easily match various types of portable units. The main problem to be considered when using a microstrip antenna is its narrow bandwidth, which is usually less than 1%, depending on the thickness of the antenna. Most portable digital cordless telephones require the antenna to have an impedance bandwidth of, at least, 3% or 4% at 900 MHz.

Parasitic elements gap-coupled to a rectangular patch antenna have been used for improving the impedance characteristics of the conventional half-wavelength rectangular microstrip antennas. In such a case, the parasitic and the driven elements, resonating at adjacent frequencies, give flat impedance characteristics over a wide band of frequencies. However, these configurations increase the overall size of the antenna considerably.

SUMMARY OF THE INVENTION

The foregoing and other problems are overcome by an antenna structure that is constructed in accordance with this invention. More particularly, this invention provides a wide bandwidth, double C-patch antenna on a very small (truncated) ground plane. The wide bandwidth, double C-patch antenna may have rectangular or non-rectangular aperture shapes, and may have a planar or a non-planar (curved about one or more axes) construction.

A wide bandwidth, shorted, microstrip antenna, preferably a shorted, double C-patch antenna, is comprised of a ground plane, a layer of dielectric material having a first surface overlying the ground plane and an opposing second surface, and an electrically conductive layer overlying the second opposing surface of the dielectric layer. The electrically conductive layer is differentiated into a plurality of antenna elements, including a driven element and one or more adjacent non-driven (parasitic) elements. The parasitic elements are electrically coupled to the driven element along opposing edges that are separated by a gap. Each antenna element has the shape of a parallelogram and has a rectangularly or a non-rectangularly shaped aperture having a length that extends along a first edge of the electrically conductive layer and a width that extends towards an oppositely disposed second edge. The length has a value that is equal to approximately 20% to approximately 35% of a length of the first edge. In a presently preferred partially shorted embodiment each antenna element further includes an electrically conductive shorting path for shorting the electrically conductive layer to the ground plane at a region adjacent to a third edge of the electrically conductive layer. The driven element also includes a coupler for coupling its electrically conductive layer to at least one of an output of a transmitter and to an input of a receiver.

The ground plane may be truncated, and has dimensions that are approximately equal to the dimensions of the electrically conductive layer.

In one embodiment of this invention the antenna is enclosed within a wireless communications PC card having dimensions of 8.5 cm×5.4 cm by 0.5 cm, and is thus form and fit compatible with a PCMCIA Type II PC card. In other preferred embodiments of this invention the wide bandwidth, shorted double C-patch antenna is contained within a hand-held wireless telephone, such as a handset of a portable telephone. For this embodiment a second wide bandwidth, shorted double C-patch antenna may be contained within a base station unit of the portable telephone.

The aperture shapes of the driven and one or more parasitic elements may be, by example, rectangular, triangular, parabolic, elliptical, or pentagonal, wherein the non-rectangular aperture shapes generally increase the sensitivity to different polarizations. The antenna may be planar or may be curved, in which case the curvature of the antenna may be generally positive or negative, and may be about one axis or about two axes.

BRIEF DESCRIPTION OF THE DRAWINGS

The above set forth and other features of the invention are made more apparent in the ensuing Detailed Description of the Invention when read in conjunction with the attached Drawings, wherein.

DETAILED DESCRIPTION OF THE INVENTION

Figure 2:
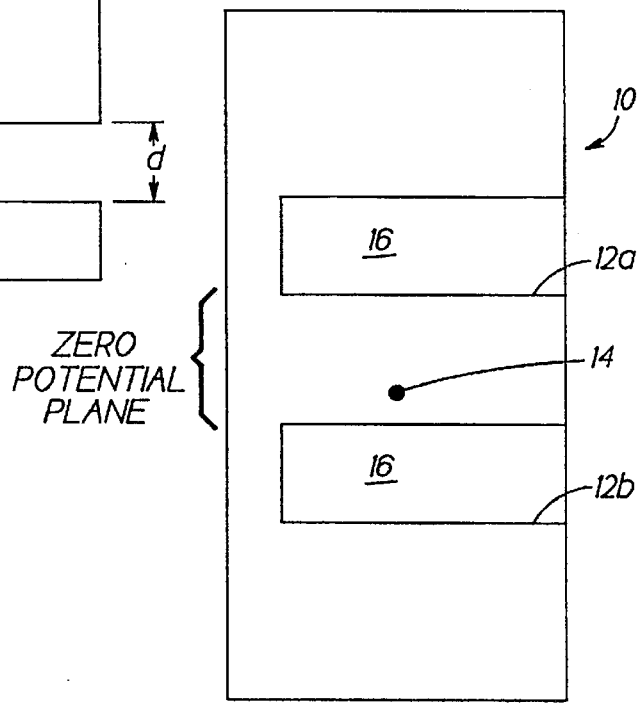
FIG. 2 is a plane view of a double C-patch antenna in accordance with an aspect of this invention.

FIG. 2 illustrates, in accordance with the above-referenced commonly assigned U.S. patent application Ser. No. 08/414,573, filed Mar. 31, 1995, entitled "A Small Double C-Patch Antenna Contained in a Standard PC Card", by Mohamed Sanad, the geometry of a double C-patch antenna 10, having rectangularly shaped apertures 12*a* and 12*b*. This antenna structure differs most significantly from the above-described C-patch antenna described by Kossiavas et al. by having two radiating apertures 12*a* and 12*b*, as opposed to the single aperture described in the article. The antenna 10 is coaxially fed at the point 14 which is asymmetrically located between the two apertures 12*a* and 12*b* (i.e., the point 14 is located nearer to one of the apertures than the other). The region between the two apertures 12*a* and 12*b* is a zero potential plane of the antenna 10. A ground plane (not shown) covers a back surface of the antenna 10, and is spaced apart from the antenna metalization 18 by an intervening dielectric layer 16. The dielectric layer 16 is exposed within the regions that correspond to the apertures 12*a* and 12*b*. The various dimensional relationships between the antenna elements will be made apparent during the discussion of the partially shorted embodiment described next, it being realized that the embodiment of FIG. 2 is essentially a mirror image of the embodiment of FIG. 3.

Figure 1:
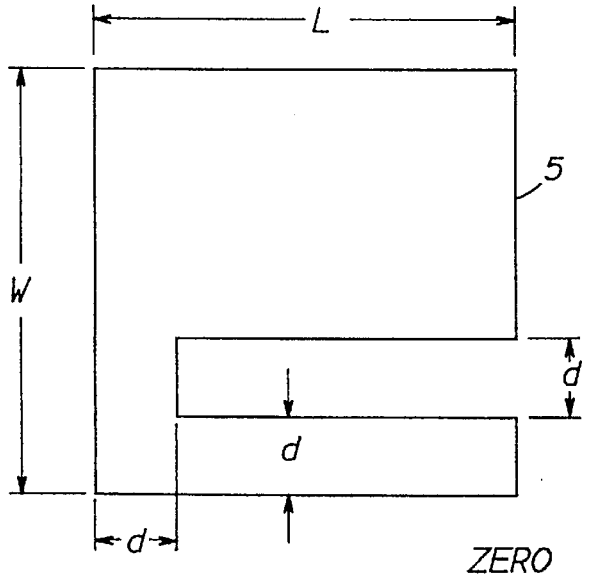
FIG. 1 PRIOR ART
FIG. 1 is a plane view of a prior art C-patch antenna structure.

In general, and for a selected resonant frequency, the antenna 10 of FIG. 2 has a smaller size than a conventional half-wavelength rectangular microstrip antenna. Furthermore, for a selected resonant frequency, the antenna 10 has a smaller size than the conventional C-patch antenna 5 shown in FIG. 1. However, for some applications (such as a PCMCIA application) the overall area of the double C-patch antenna 10 may still be too large.

Figure 3:
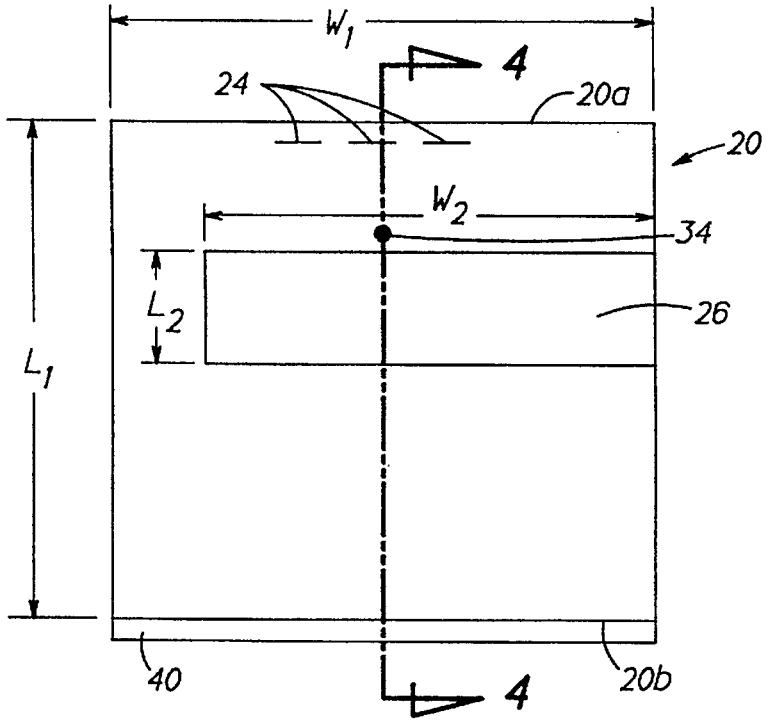
FIG. 3 is an enlarged plane view of a partially shorted, double C-patch antenna having a rectangular aperture shape.
Figure 4:
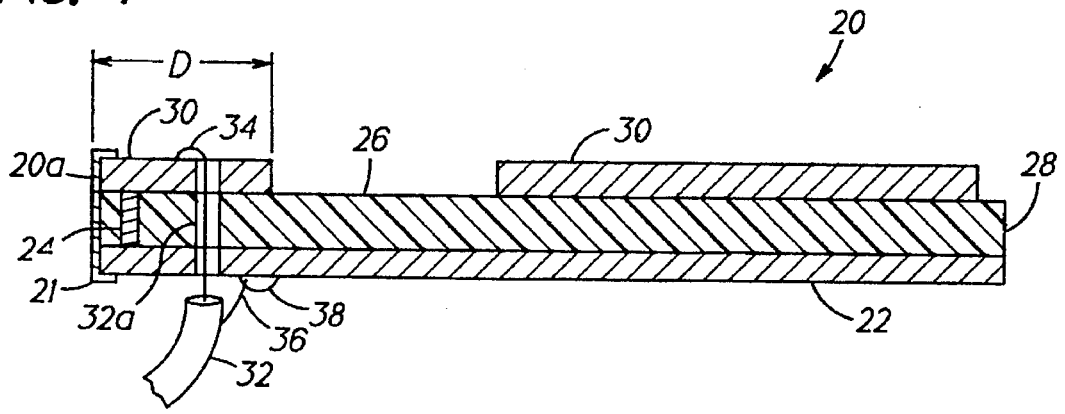
FIG. 4 is a cross-sectional view, not to scale, taken along the section line 4—4 of FIG. 3.

FIGS. 3 and 4 illustrate a partially shorted, double C-patch antenna 20 in accordance with the invention disclosed in the above-referenced commonly assigned U.S. patent application Ser. No. 08/414,573, filed Mar. 31, 1995, entitled "A Small Double C-Patch Antenna Contained in a Standard PC Card", by Mohamed Sanad. To reduce the overall length of the double C-patch antenna 20 to approximately one half of the length shown in FIG. 2, the zero potential plane of the antenna 10, which lies between the two apertures and which is excited with the dominant mode, is short-circuited by a plurality of electrically conductive vias or posts 24. To further reduce the size of the partially shorted, double C-patch antenna 20 only a small portion of the entire length of the shorted edge 20*a* is shorted-circuited (hence the term 'partially shorted').

Although the partially shorted embodiment is presently preferred, it is also within the teaching of the invention to provide a continuous short along the edge 20*a*. By example, a length of electrically conductive material (e.g., electrically conductive tape shown as 21 in FIG. 4) can be wrapped around the edge 20*a* to short the ground plane 22 to the radiating patch metalization 30.

The entire length of the partially shorted edge 20*a* is defined to be the width (W1) of the antenna 20, while the length (L1) of the antenna is the distance between the partially shorted edge 20*a* and the main radiating edge 20*b* which is parallel to the partially shorted edge 20*a*. The side of the rectangular aperture 26 which is parallel to the partially shorted edge is defined to be the width (W2) of the aperture 26, while the side of the aperture that is perpendicular to the width W2 is defined to be the aperture length L2. The length (L1) of the partially shorted, double C-patch antenna 20 is less than one half of the length of a conventional quarter-wavelength shorted rectangular microstrip antenna resonating at the same frequency and having the same width and thickness. It should be noted that the Length and Width convention in FIG. 3 has been reversed from that used when describing the conventional C-patch antenna of FIG. 1.

It should be further noted that the geometry of the double C-patch antenna embodiment of FIG. 2, in particular the existence of the zero potential plane between the apertures 12*a* and 12*b*, makes it possible to form the partially shorted embodiment of FIG. 3. That is, the conventional C-patch antenna shown in FIG. 1, because of a lack of such symmetry, is not easily (if at all) capable of having the radiating patch shorted to the ground plane.

Example 1

An embodiment of the partially shorted, double C-patch antenna 20 is designed to resonate at approximately 900 MHz, a frequency that is close to the ISM, cellular and paging frequency bands specified for use in the United States. The total size (L1×W1) of the antenna 24 is 2.7 cm×2.7 cm. The antenna 20 employs a dielectric layer 28 comprised of, by example, Duroid 6002 having a dielectric constant of 2.94 and a loss tangent of 0.0012. The thickness of the dielectric layer is 0.1016 cm. A density of electrodeposited copper clad that forms the ground plane 22 and the patch antenna metalization 30 is 0.5 oz per square foot. The length (L2) of the aperture 26 is 0.7 cm, the width (W2) of the aperture 26 is 2 cm, and the edge of the aperture 26 is located 0.6 cm from the partially shorted edge 20*a* (shown as the distance D in FIG. 4). That is, in the preferred embodiment D is approximately equal to L2. The input impedance of the antenna 20 is approximately 50 ohms, and the antenna is preferably coaxially fed from a coaxial cable 32 that has a conductor 32*a* that passes through an opening within the ground plane 22, through the dielectric layer 28, and which is soldered to the antenna radiating patch metalization 30 at point 34. A cable shield 36 is soldered to the ground plane 22 at point 38. The coaxial feed point 34, for a 50 ohm input impedance, is preferably located at a distance that is approximately D/2 from the partially shorted edge 20*a*, and approximately W½ from the two opposing sides that are parallel to the length dimension L1. The exact position of the feed point 34 for a given embodiment is a function of the desired input impedance. A clearance area 40 of approximately 2 mm is left between the radiating edge 20*b* of the antenna and the edge of the dielectric layer 28.

It has been determined that the effect of the human body on the operation of the antenna 20 is negligible. This is because such a double C-patch antenna configuration is excited mainly by a magnetic current rather than by an electric current. Furthermore, the ground plane 22 of the antenna 20 also functions as a shield against adjacent materials, such as circuit components in the PCMCIA communication card 1 and any other metallic materials that may be found in the PCMCIA slot 3.

The ground plane 22 of the antenna 20 is preferably truncated. In the disclosed embodiments the dimensions of the ground plane 20 are nearly the same as those of the radiation patch 30. Because of this, and because of the geometry of the partially shorted, double C-patch antenna 20, the generated radiation patterns are isotropic. Furthermore, the antenna 20 is sensitive to both vertically and horizontally polarized waves. Moreover, the total size of the antenna 20 is much smaller than a conventional quarter-wavelength rectangular microstrip antenna, which conventionally assumes infinitely large ground plane dimensions.

However, it should be noted that truncating the ground plane 22 of the partially shorted, double C-patch antenna 20 does not adversely effect the efficiency of the antenna. This is clearly different from a conventional rectangular microstrip antenna, where truncating the ground plane along the radiating edge(s) reduces the gain considerably.

To improve the manufacturability of the shorted, double C-patch antenna 20, the electric short circuit at the shorted edge 20*a* is made by a small number (preferably at least three) of the relatively thin (e.g., 0.25 mm) shorting posts 24. However, and as was stated previously, it is within the scope of the invention to use a continuous short circuit that runs along all or most of the edge 20*a*.

The partially shorted, double C-patch antenna 20 does not have a regular shape and, as such, it is difficult to theoretically study the effect of the circuit components in the PCMCIA card and the metallic materials in the PCMCIA slot on the operation of the antenna. Therefore, the performance of the partially shorted, double C-patch antenna 20, both inside and outside the PCMCIA Type II slot 3, has been determined experimentally.

Figure 5:
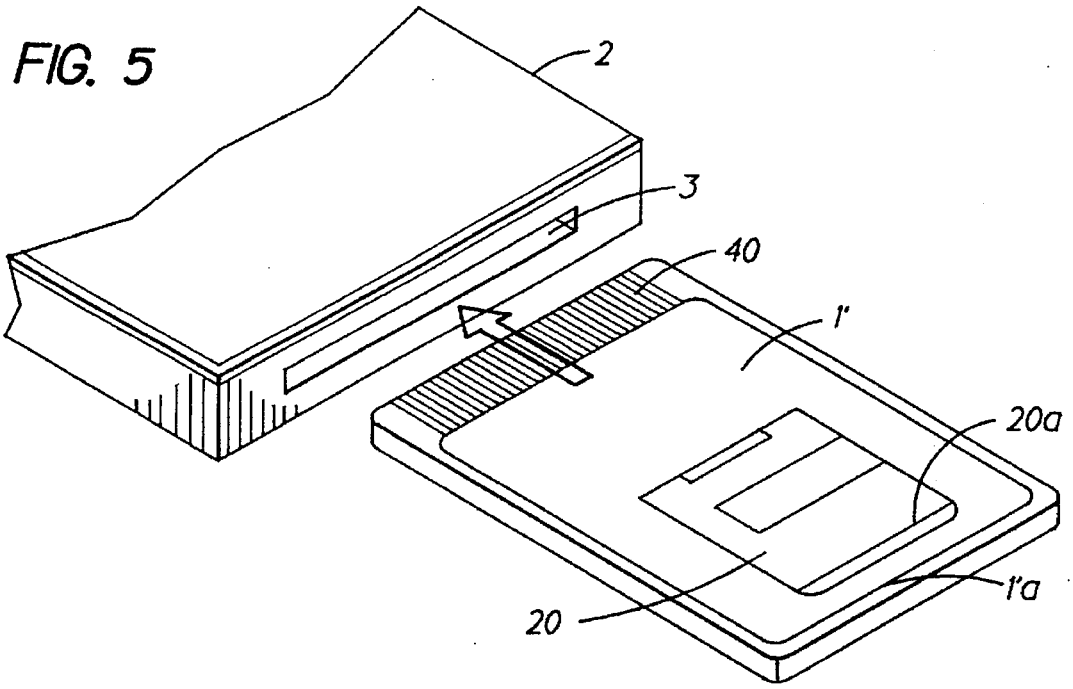
FIG. 5 shows a preferred orientation for the partially shorted, double C-patch antenna of FIG. 3 when contained within a wireless communications PCMCIA PC card that is installed within a host system.

Referring to FIG. 5, when making the measurements the antenna 20 was located close to the outer edge 1*a'* of a PCMCIA card 1' with the main radiating edge 20*a* of the antenna 20 was facing outward (i.e., towards the slot door when installed). In this case, and when the PCMCIA card 1' is completely inserted inside the PCMCIA slot 3, the main radiating edge 20*a* of the antenna 20 is approximately parallel with and near to the outer door of the slot 3. It should be realized when viewing FIG. 5 that, in practice, the antenna 20 will be contained within the outer shell of the PCMCIA card enclosure, and would not normally be visible to a user.

Figure 6:
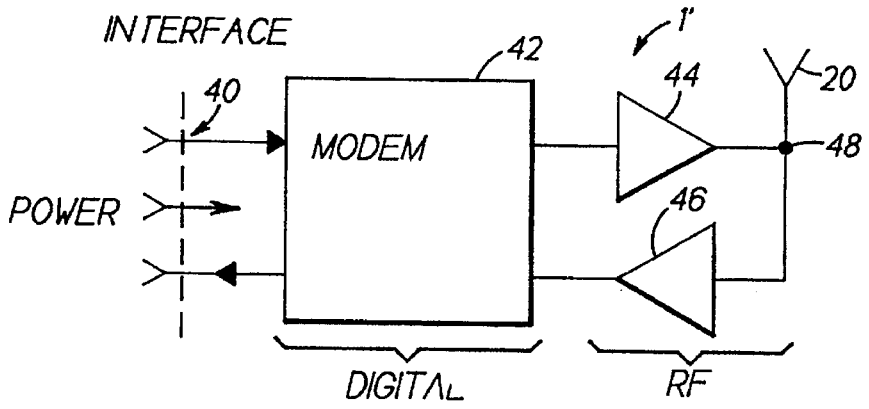
FIG. 6 is a simplified block diagram of the wireless communications PCMCIA PC card of FIG. 5.
Figure 7:
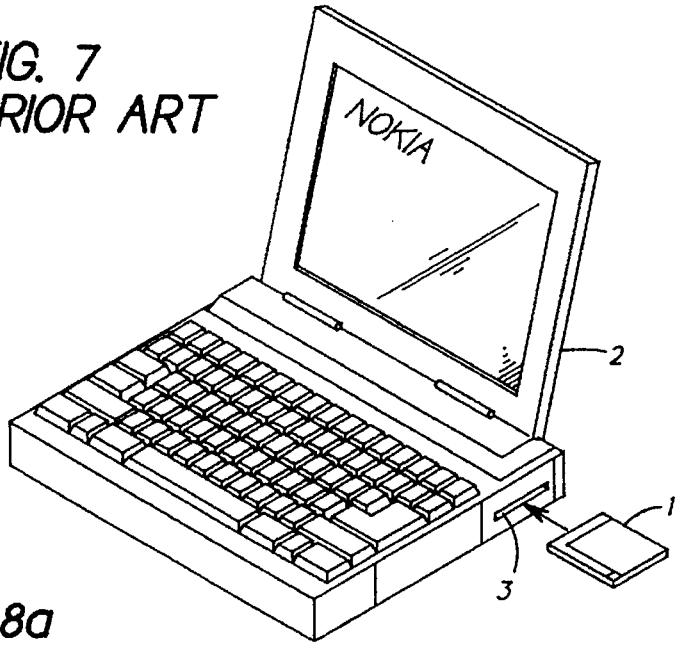
FIG. 7 PRIOR ART
FIG. 7 is a simplified elevational view of a portable computer and a PCMCIA PC card, in accordance with the prior art.

FIG. 6 is a simplified block diagram of the wireless communications PCMCIA card 1' that is constructed to include the shorted or partially shorted double C-patch antenna. Referring also to FIG. 5, the card 1' includes a PCMCIA electrical interface 40 that bidirectionally couples the PCMCIA card 1' to the host computer 2. The PCMCIA card 1' includes a digital modulator/demodulator (MODEM) 42, an RF transmitter 44, an RF receiver 46, and the partially shorted, double C-patch antenna 20 (FIGS. 3 and 4). A diplexer 48 can be provided for coupling the antenna 20 to the output of the transmitter 44 and to the input of the receiver 46. Information to be transmitted, such as digital signalling information, digital paging information, or digitized speech, is input to the modem 42 for modulating an RF carrier prior to amplification and transmission from the antenna 20. Received information, such as digital signalling information, digital paging information, or digitized speech, is received at the antenna 20, is amplified by the receiver 46, and is demodulated by the modem 42 to recover the baseband digital communications and signalling information. Digital information to be transmitted is received from the host computer 2 over the interface 40, while received digital information is output to the host computer 2 over the interface 40.

It is been determined that inserting the antenna 20 inside of the PCMCIA Type II slot 3 has a negligible effect on the resonant frequency and the return loss of the antenna. The corresponding radiation patterns were measured in the horizontal plane. In these measurements, the antenna 20 was immersed in both vertically and horizontally polarized waves to determine the dependence of its performance on the polarization of the incident waves. It has been determined that the radiation patterns are nearly isometric and polarization independent. Furthermore, the performance of the antenna 20 inside the PCMCIA Type II slot 3 is excellent, and is substantially identical to the performance outside of the slot. Similar results were obtained in the other polarization planes. However, the horizontal plane is the most important one for this application, especially if the PCMCIA card 1' is operating inside the PCMCIA slot 3 within a personal computer, because personal computers are usually operated in a horizontal position.

The measurements were repeated inside several PCMCIA slots in different portable computers and similar results were obtained. Furthermore, these measurements were repeated while a palmtop computer, containing the antenna 20 inside its PCMCIA slot 3, was hand-held and also while inside the operator's pocket. It was found that the human body has a negligible effect on the performance of the antenna 20.

In accordance with the foregoing it has been shown that the small, shorted (partial or continuous), double C-patch antenna 20, on a truncated ground plane, has been successfully integrated with a wireless communications PCMCIA card 1'. The shorted, double C-patch antenna 20 has the same performance characteristics in both free space and inside the PCMCIA slot 3 of a personal computer. The PCMCIA card 1' containing the antenna 20 has a good reception sensitivity from any direction, regardless of its orientation, because the shorted, double C-patch antenna 20 has isotropic radiation patterns and is sensitive to both vertically and horizontally polarized radio waves. Furthermore, the shorted, double C-patch antenna 20 exhibits excellent performance when closely adjacent to the human body. As a result, the wireless communications PCMCIA card 1' exhibits a high reception sensitivity when it is hand-held and also when it operated inside of an operator's pocket.

Having thus described the various embodiments of the double C-patch antenna disclosed in the above-referenced commonly assigned U.S. patent aplication Ser. No. 08/414,573, filed Mar. 31, 1995, entitled "A Small Double C-Patch Antenna Contained in a Standard PC Card", by Mohamed Sanad, various improvements to and further embodiments of the double C-patch antenna will now be disclosed.

Figure 8A:
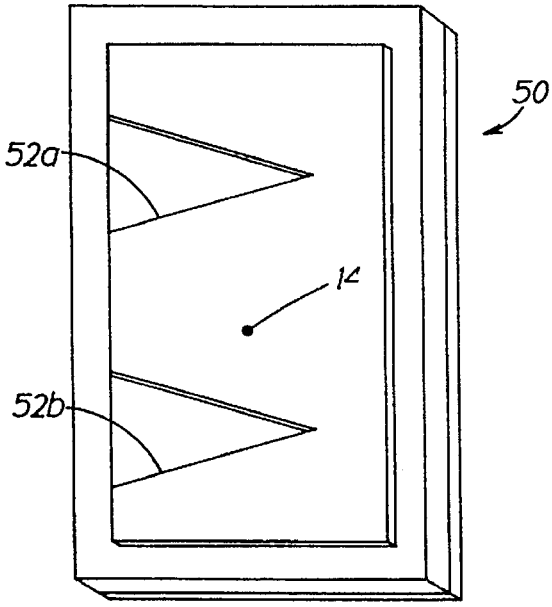
FIG. 8*a* is an elevational view of a double C-patch antenna having triangularly shaped apertures in accordance with an aspects of this invention.

FIG. 8*a* illustrates the geometry of a double C-patch antenna 50 having two triangularly shaped apertures 52*a* and 52*b*, as opposed to the two rectangularly shaped apertures 12*a* and 12*b* illustrated in FIG. 2. The antenna 50 is coaxially fed at point 14 between the two apertures 52*a* and 52*b*.

Figure 8B:
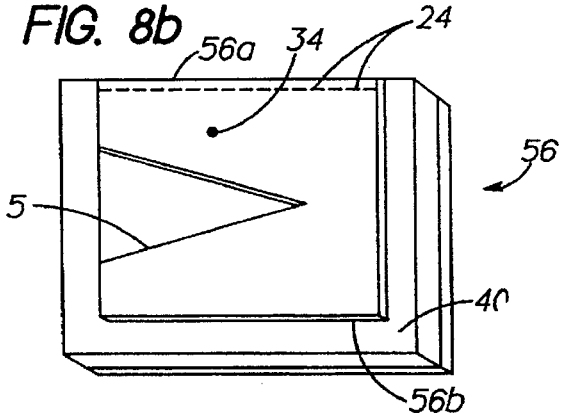
FIG. 8*b* is an elevational view of a partially shorted, double C-patch antenna having a triangularly shaped aperture.

To reduce the size of the antenna 50 by approximately one half, the zero potential plane of the antenna 50 is short-circuited as shown in FIG. 8*b*. To further reduce the size of the double C-patch antenna, the zero potential plane is short-circuited with conductive posts 24 to form a partially shorted embodiment 56. A continuously shorted embodiment is also within the scope of the teaching of this invention. The partially shorted double C-patch antenna 56 is fed at point 34 between the single triangular aperture 58 and the shorted edge 56*a*, the feed point 34 being located on a line of the antenna which passes through the center of the shorted edge 56*a*.

In addition to the triangularly shaped apertures 52*a*, 52*b* and 58 shown in FIGS. 8*a* and 8*b*, and also the rectangularly shaped aperture 12*a*, 12*b* and 26 shown in FIGS. 2 and 3, double C-patch antennas having other aperture shapes are also within the scope of the teaching of this invention. Although described below in the context of the physically smaller, shorted or partially shorted embodiments, these other aperture shapes can also be used with the non-shorted embodiments shown in FIGS. 2 and 8*a*.

Figure 9:
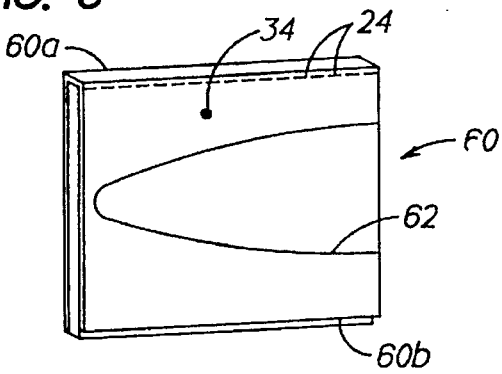
FIG. 9 is an elevational view of a partially shorted, double C-patch antenna having a parabolically shaped aperture.
Figure 10:
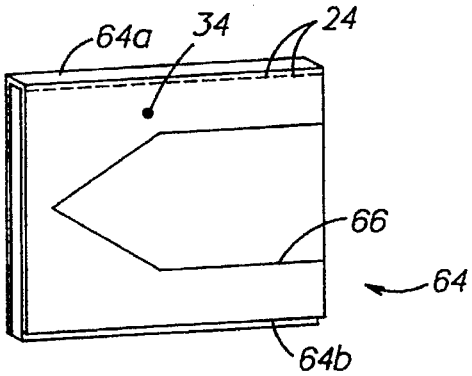
FIG. 10 is an elevational view of a partially shorted, double C-patch antenna having a pentagonally shaped aperture.

For example, FIG. 9 shows a partially shorted double C-patch antenna 60 having an elliptically shaped or a parabolically shaped aperture 62, while FIG. 10 shows a partially shorted double C-patch antenna 64 having a pentagonally shaped aperture 66.

Regardless of the shape of the apertures 26, 58, 62 and 64, the dimension of the aperture in the direction parallel to the shorted edge 20*a*, 56*a*, 60*a* and 64*a*, respectively, is defined as the width of the aperture. The dimension of the aperture in the direction perpendicular to the shorted edge 20*a*, 56*a*, 60*a*, 64*a* is considered to be its length (see also FIG. 3). For those embodiments wherein the aperture length is not constant (e.g., FIGS. 8*a*, 8*b*, 9 and 10), the length is measured at its widest point (e.g., at the antenna edge that is perpendicular to the shorted edge). The length of the shorted edge is defined to be the width of the antenna, while the length of the antenna is the distance between the shorted edge 20*a*, 56*a*, 60*a*, 64*a* and the main radiating edge 20*b*, 56*b*, 60*b*, 64*b*, respectively, which is parallel to the shorted edge.

The various embodiments of the double C-patch antenna have several design parameters that can be used to optimize the performance and to control the resonant frequency and input impedance.

By example, and in addition to the length and the width of the antenna, the dimensions of the apertures have a significant effect on the characteristics of the antenna. In general, for a fixed size of the antenna, decreasing the length of the aperture reduces the resonant frequency and increases the input impedance of the antenna. However, the length of the aperture is preferably not decreased less than approximately 20% of the total length of the antenna, otherwise the efficiency of the antenna may begin to decrease. On the other hand, increasing the width of the aperture increases the input impedance and consequently reduces the resonant frequency. In general, it has been determined that the width of the aperture should not be greater than approximately 75% of the total width of the antenna to avoid a significant reduction in the efficiency of the antenna. Also, it has been found that the position of the aperture has some effect on the antenna performance. For example, moving the aperture closer to the shorted edge has been found to reduce the resonant frequency.

In general, and assuming that the surface areas of the apertures are maintained approximately constant, the aperture shape has a small effect on the resonant frequency and the input impedance of the shorted or partially double C-patch antenna. On the other hand, the aperture shape has a significant effect on the performance of the antenna beside the human body. In the vicinity of a human body, it has been found that the double C-patch antenna 20, having the rectangularly shaped aperture 26 (FIG. 3) has the best performance, while the double C-patch antenna 60, having the elliptically shaped aperture 62, experiences the greatest performance degradation.

However, it should be noted that the effect of the human body on the double C-patch antenna embodiments of this invention, having any aperture shape (e.g., rectangular, elliptical, parabolic, pentagonal, triangular, etc.), is less than the effect on the conventional rectangular microstrip antenna. To even further reduce the effect on the human body of the double C-patch antenna, the ground plane is truncated such that its size is almost equal to the size of the radiation patch. Fortunately, truncating the ground plane of the antenna also increases its sensitivity to both horizontally and vertically polarized waves, and also improves the isotropic characteristics of the radiation patterns. These features are very important in many antenna applications, such as in portable communication equipment which are usually hand-held close to the operator's body and randomly orientated. However, it should be noted that truncating the ground plane of the double C-patch antenna does not have any significant effect on the efficiency of the antenna. This is different from the conventional rectangular microstrip antenna, where truncating the ground plane beside the radiating edge(s) reduces the gain considerably.

Example 2

Duroid 5880 having a dielectric constant of 2.2 and a thickness of 1.27 mm was used to manufacture a 37.5×37.5 mm shorted (fully) double rectangular C-patch antenna. A rectangular aperture was disposed 9 mm from the shorted edge. The length of the aperture was 10 mm and its width was 26 mm. The ground plane was truncated such that its width was the same as the width of the radiation patch. The length pf the ground plane was just 2 mm longer than the radiation patch. The input impedance was 50 ohms when the feed point was placed 4.5 mm from the shorted edge, and the resonant frequency was 1.024 GHz. Generally, it was found that the proximity of a human body had a negligible effect on the double C-patch antenna. The antenna was then immersed in both vertically and horizontally polarized waves and the corresponding radiation patterns in the plane of the antenna were measured. It was found that the antenna was sensitive to both polarizations, and that the radiation patterns were quasi-isotropic. Similar results were obtained in the other principal planes.

Figure 11:
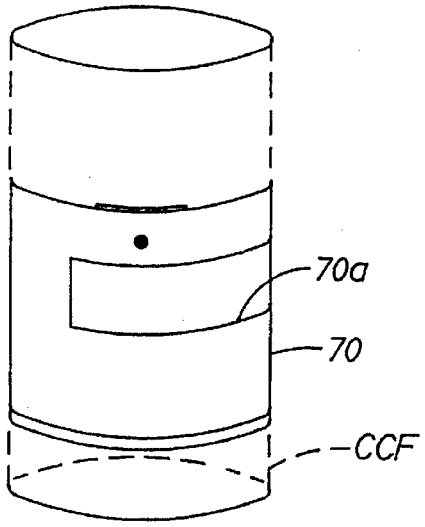
FIG. 11 is an elevational view of a first embodiment of a partially shorted, non-planar double C-patch antenna.
Figure 12:
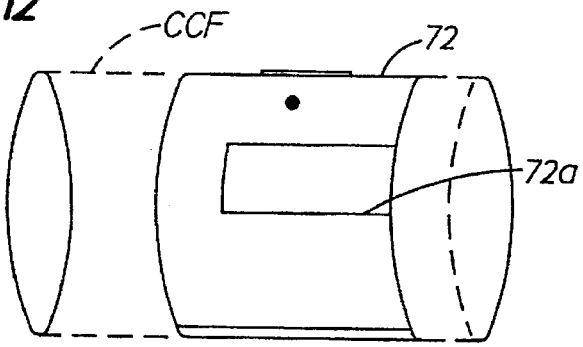
FIG. 12 is an elevational view of a second embodiment of a partially shorted, non-planar double C-patch antenna.
Figure 13:
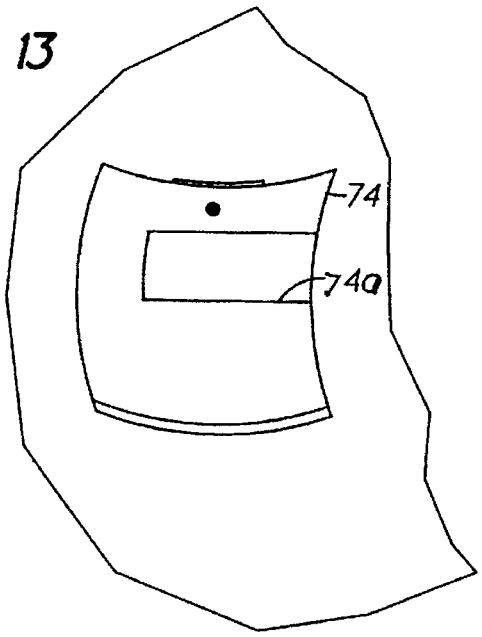
FIG. 13 is an elevational view of a third embodiment of a partially shorted, non-planar double C-patch antenna.

Referring now to FIGS. 11, 12 and 13, there are illustrated several embodiments of shorted or partially shorted double C-patch antennas that are non-planar. Although these antennas are illustrated to have rectangularly-shaped apertures, any of the various non-rectangular aperture embodiments described previously may also be used.

FIGS. 11 and 12 illustrate embodiments wherein the antennas 70 and 72 are curved about one major axis (e.g, the x-axis), while FIG. 13 illustrates an antenna 74 that is curved about two major axes (e.g., the x and y axes). In all of these embodiments it has been found that the curvature does not adversely impact the electrical and RF characteristics of the antenna.

More particularly, FIGS. 11 and 12 illustrate embodiments wherein the antennas 70 and 72 can be considered to be curved about a circular cylindrical form (CCF). In FIG. 11 the aperture 70*a* faces away from the circular cylindrical form, and this curvature can be considered as a positive curvature. In FIG. 12 the aperture 72*a* faces towards the circular cylindrical form, and this curvature can be considered as a negative curvature.

FIG. 13 illustrates a double C-patch antenna 74 embodiment wherein the antenna 74 can be considered to lie on a surface of a sphere (or any body of revolution), and to thus be curved in two axes. Similar to the embodiments of FIGS. 11 and 12, in FIG. 13 the aperture 74*a* faces away from the spherical form, and this curvature can be considered as a positive curvature. If the aperture 74*a* instead faces towards the spherical form (not illustrated), then this curvature can be considered as a negative curvature.

The radius of curvature of the various embodiments of curved microstrip antennas may range from zero degrees to 360 degrees.

The ability to curve the shorted or partially shorted microstrip antenna about at least one axis, such as the shorted or partially shorted double C-patch antenna, without significantly affecting the characteristics of the antenna, enables its use in a number of applications that for one reason or another (e.g., lack of space, a hand held communicator having a curved outer surface, etc.) makes the use of a planar, non-curved antenna less desirable.

Figure 14:
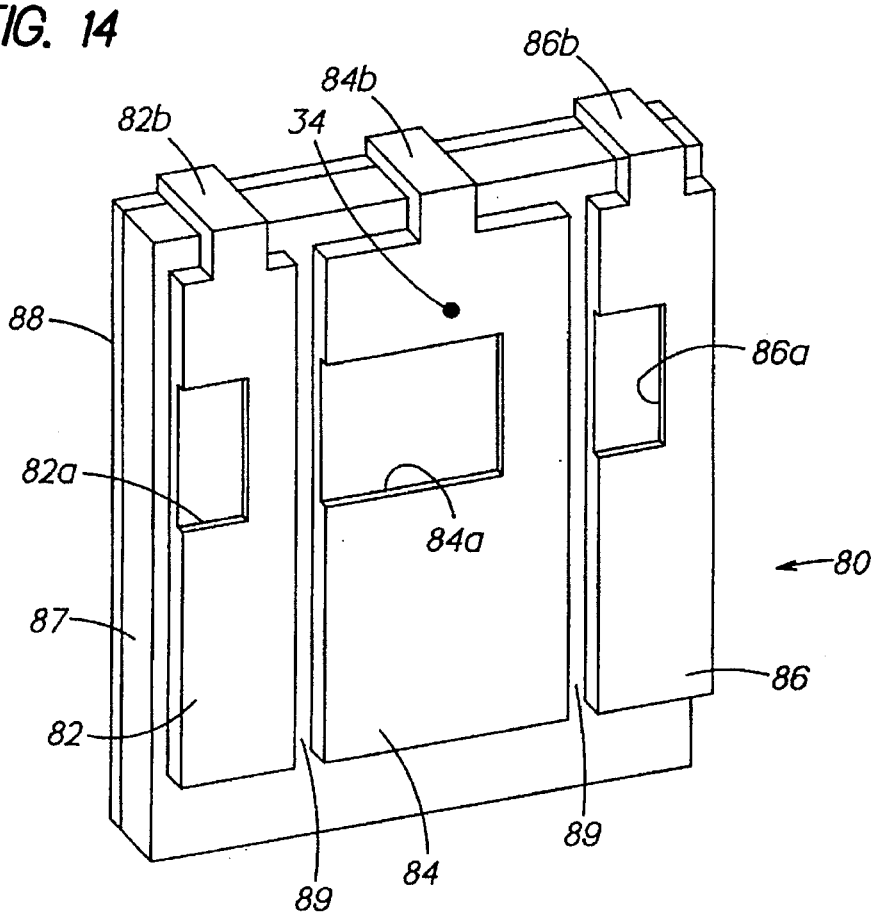
FIG. 14 is an elevational view (not to scale) of a partially shorted, wide band double C-patch antenna having gap-coupled parasitic elements.

Further in accordance with this invention the geometry of an exemplary wide band, shorted microstrip antenna 80 is illustrated in FIG. 14. In a presently preferred embodiment the antenna 80 includes three partially shorted double C-patch elements 82, 84 and 86 having rectangularly shaped apertures 82*a*, 84*a* and 86*a*, respectively. Partially shorted double C-patch antennas having, by example, triangular, elliptical or polygonal aperture shapes may also be used. Furthermore, the antenna 80 may be curved about one or more axes thereof, such as was illustrated in FIGS. 11–13. However, it should be realized that curving the antenna 80 about at least one axis may affect the performance as compared to a planar (non-curved) embodiment.

Only the central double C-patch antenna 84 is fed coaxially (at point 34) while the other two double C-patch antennas 82 and 86 are parasitic elements that are coupled to the driven element 84 across intervening gaps 89. Although two parasitic elements are illustrated, it is within the scope of this invention to use one parasitic element, or to use more than two parasitic elements.

The total size of the wide band double C-patch antenna 80 is significantly smaller than the size of conventional wide band microstrip antennas, while providing the same frequency bandwidth. This is due in part to the fact that the size of each partially shorted double C-patch element is less than 25% of the size of a conventional half-wavelength rectangular microstrip antenna that resonates at the same frequency. On the other hand, reducing the sizes of the radiation patches also reduces the coupling between the edges of the driven and the parasitic elements. However, in the wide bandwidth double C-patch antenna in accordance with this invention, the reduction in the length of the coupling edges is compensated for by the coupling effects due to the edges of the apertures 82*a*, 84*a* and 86*a*.

The wide bandwidth double C-patch antenna 80 has a number of parameters that can be designed to optimize the characteristics of the antenna, especially the bandwidth. The most sensitive design parameters are the length and shape of the driven and the parasitic elements, and the dimensions and the locations of their apertures. The width of the partial short circuit 82*b*, 84*b* and 86*b* of each antenna element to the rear ground plane 88, and the location of the feed point 34, have a significant effect on the input impedance of the antenna 80. Also, the dimensions of the ground plane 88 have a significant effect on the performance of the wide bandwidth, double C-patch antenna 80.

As in the embodiments described previously, truncating the ground plane 88 improves the isotropic characteristics of the radiation patterns of the antenna, increases its sensitivity to both vertically and horizontally polarized waves, and reduces the effect of the human body on the antenna. Therefore, the ground plane 88 of the wide band double C-patch antenna 80, such as when contained in a handset 90 of hand held portable telephone (FIG. 15), is preferably truncated such that its dimensions are approximately the same as the dimensions of the radiation patches. This is because the portable handset 90 is typically used in close proximity the user's head and hand, and furthermore is usually randomly orientated. On the other hand, the effect of the human body on the antenna contained in a base station of the portable phone is not a significant factor because the base station does not normally operate in close proximity to the user's body. It can thus be appreciated that the ground plane of the base station antenna may be extended somewhat more than the ground plane of the antenna 80 contained in the handset 90 in order to reduce the amount of radiation directed towards the floor, and also towards the wall on which the base station is typically mounted.

Example 3

Figure 15:
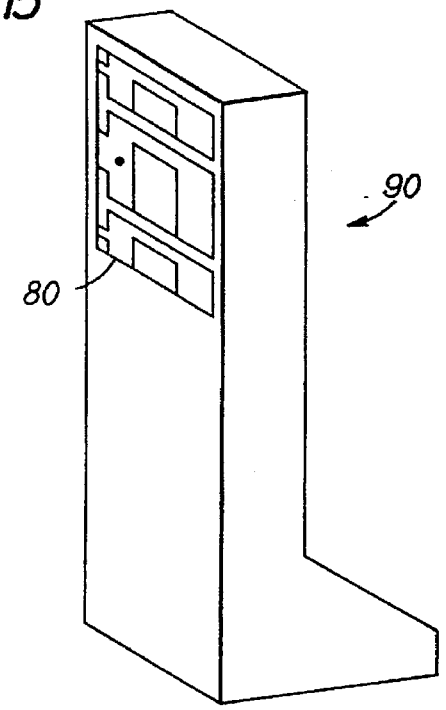
FIG. 15 is a simplified, partially cut-away depiction of a hand-held user terminal that contains the partially shorted double C-patch antenna of FIG. 14.
Figure 16:
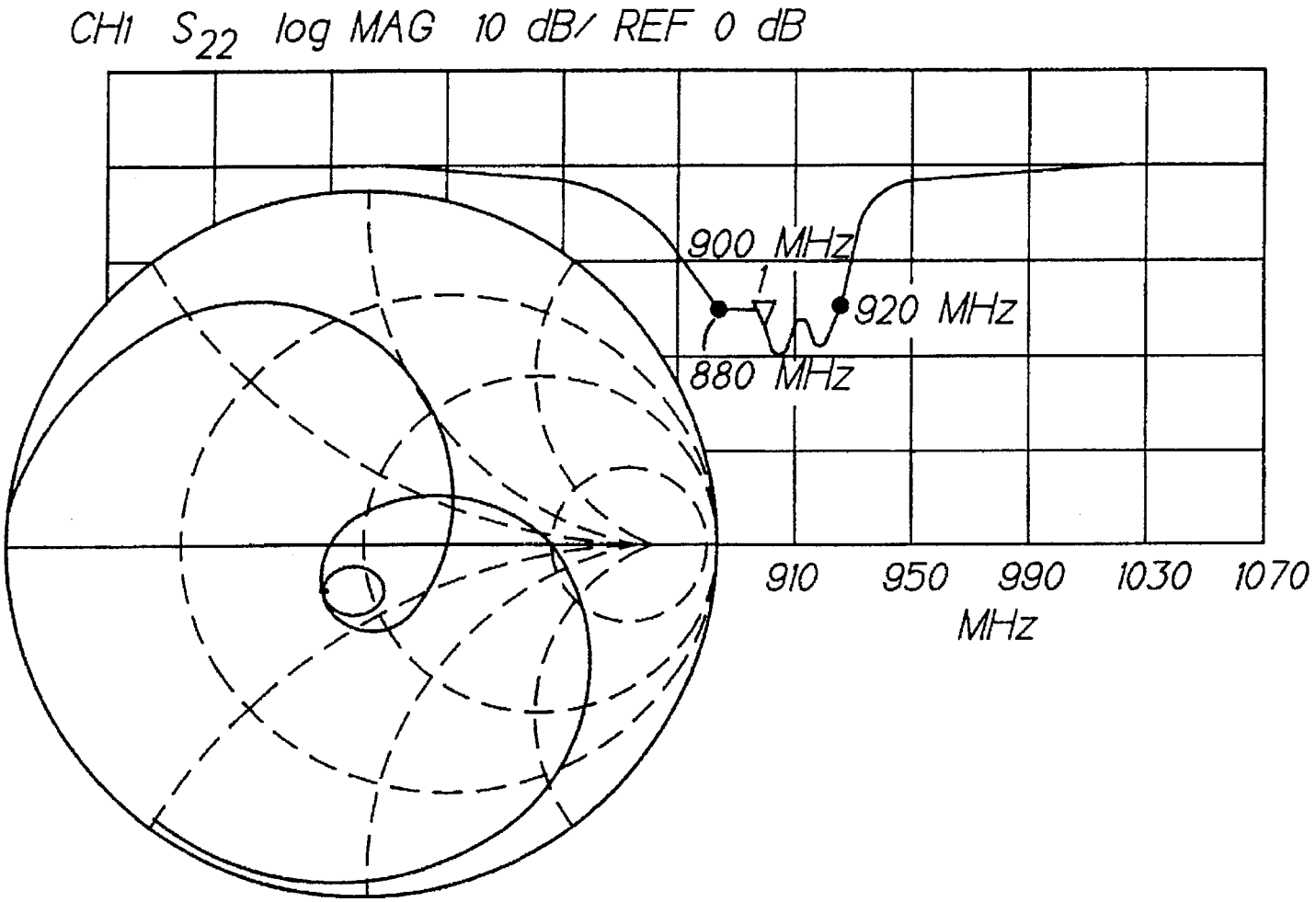
FIG. 16 is a graph that illustrates the return loss and input impedance of the wide band double C-patch antenna of FIGS. 14 and 15.

FIG. 16 illustrates the return loss and the input impedance of an embodiment of the wide bandwidth double C-patch antenna 80. In this configuration, the dimensions of the apertures 82*a*, 84*a* and 86*a*, and also the total sizes of the driven element (84) and the two parasitic elements (82 and 86), were equal. The length of each element was 42 mm, the width of each element was 14 mm, and the gap 89 between adjacent elements was 1.5 mm wide. The length of each rectangular aperture was 11 mm and the width was 9 mm. The dielectric material 87 was 2.3 mm thick and had a dielectric constant of 3.25. The width of the short-circuited section (84*b*) of the driven element was 6 mm (partially shorted). The aperture 84*a* was located 10 mm from the partially shorted edge while the feed point 34 was located 4 mm from the same, partially shorted edge. The widths of the short-circuited sections 82*b* and 86*b* of the parasitic elements 82 and 86 were 4 mm and 8 mm, and their apertures 82*a* and 86*a* were located at 11 mm and 9 mm from their partially shorted edges, respectively. The central resonant frequency was approximately 900 MHz and the bandwidth (−12.5 dB return loss or less) was approximately 40 MHz (i.e., greater than 4%). The ground plane 88 of the antenna was truncated such that its dimensions were only 1 mm larger than the dimensions of the radiation patches from each side of the antenna. The antenna 80 was contained in the handset 90 of a cordless telephone, as shown in FIG. 15. It was found that the antenna 80 was sensitive to both polarizations and that its radiation patterns at 900 MHz are nearly isotropic. The radiation patterns were also measured at 880 MHz and 920 MHz and were found to be approximately the same. Furthermore, the performance degradation of the wide band double C-path antenna 80, contained in the handset 90, when the handset was hand-held close to the operators's head was found to be negligible.

It was further determined that when wide band double C-patch antennas 80 were installed within both the handset and the base station of a digital cordless telephone operating at 900 MHz, to replace the external antennas, the performance of the cordless telephone was significantly improved. For example, the coverage distances were increased by a factor ranging from 1.4 to 1.9, depending on the cordless telephone that was used. The coverage distance of the cordless telephone was defined as the maximum distance between the handset and the base station in which the telephone voice was still clear. This distance was determined using the "low signal indicator" or the "out of range indicator" which is included in many portable cordless telephones.

If desired, the width of the shorting elements 82*b*, 84*b* and 86*b* could be equal to the width of the respective electrically conductive portions of the antenna elements or, alternatively, the shorts to the ground plane could be provided by the feed through arrangement 24 shown in, by example, FIG. 4.

It should be understood that the handset 90 of FIG. 15 may be otherwise conventional in construction, and may thus include a microphone, circuitry for converting a user's voice into a digital signal for modulating an RF carrier, an RF transmitter for transmitting the modulated carrier, an RF receiver for receiving a modulated carrier, and circuitry for demodulating the received RF carrier and for generating a signal for driving a speaker. The handset may be part of a portable telephone arrangement, having a local base station, or may be a part of a cellular telephone system, having a remote base station.

The wide bandwidth, shorted double C-patch antenna 80 may also be used to advantage in some embodiments of the PCMCIA module described previously.

While the invention has been particularly shown and described with respect to preferred embodiments thereof, it will be understood by those skilled in the art that changes in form and details may be made therein without departing from the scope and spirit of the invention. By example, the various linear dimensions, thicknesses, resonant frequencies, and material types can be modified, and the resulting modified structure will still fall within the scope of the teaching of this invention. Further by example, other than the various illustrated aperture shapes can be employed. Also by example, and referring to FIG. 3, the aperture length (L2) may have a value that is equal to approximately 20% to approximately 35% of the length (L1), and a width (W2) having a value that is equal to approximately 15% to approximately 40% less than the width (W1). Furthermore, partially shorted, wide bandwidth, double C-patch antenna 80 shown in FIG. 14 can also be constructed in a non-shorted embodiment, such as that illustrated in FIGS. 2 and 8*a*.

What is claimed is:

1. An antenna structure, comprising:

a ground plane;

a layer of dielectric material having a first surface overlying said ground plane and an opposing second surface;

an electrically conductive layer overlying said second opposing surface of said dielectric layer, said electrically conductive layer being differentiated into a plurality of antenna elements including a driven antenna element and at least one non-driven, parasitic antenna element, individual ones of said parasitic antenna elements being disposed on opposite sides of said driven antenna element, each of said antenna elements having a shape of a parallelogram and having a first radiating aperture having a length that extends along a first edge of said electrically conductive layer and a width that extends towards an oppositely disposed second edge, said electrically conductive layer further having a second radiating aperture having a length that extends along said first edge of said electrically conductive layer and a width that extends towards said oppositely disposed second edge, said first and second radiating apertures having a zero potential plane disposed therebetween; and means for coupling at least one of radio frequency energy into and out of said electrically conductive layer of said driven antenna element, said coupling means being located within said zero potential plane and further being located nearer to one of said radiating apertures than the other.

2. An antenna structure as set forth in claim 1 wherein a sum of the lengths of each of said first and second apertures has a value that is equal to approximately 20% to approximately 35% of a length of said first edge.

3. An antenna structure as set forth in claim 1 wherein said width of each of said first and second apertures has a value that is equal to approximately 15% to approximately 40% less than a width of said electrically conductive layer.

4. An antenna structure as set forth in claim 1 wherein said coupling means is comprised of means for connecting a coaxial cable to said electrically conductive layer.

5. An antenna structure as set forth in claim 1, wherein said structure is curved about at least one axis.

6. An antenna structure as set forth in claim 1, wherein said apertures have a shape selected from one of a rectangular shape and a non-rectangular shape.

7. An antenna structure, comprising:

a ground plane;

a layer of dielectric material having a first surface overlying said ground plane and an opposing second surface;

an electrically conductive layer overlying said second opposing surface of said dielectric layer, said electrically conductive layer being differentiated into a plurality of antenna elements including a driven antenna element and at least one non-driven, parasitic antenna element, individual ones of said parasitic antenna elements being disposed on opposite sides of said driven antenna element, each of said antenna elements being in the shape of a parallelogram and having one of rectangular and a non-rectangular radiating aperture having a length that extends along a first edge of said electrically conductive layer of said element and a width that extends towards an oppositely disposed second edge of said element;

each of said antenna elements including means for shorting said electrically conductive layer to said ground plane at a region adjacent to a third edge of said electrically conductive layer; and means for at least coupling radio frequency energy to said electrically conductive layer of said driven antenna element, said coupling means being located between said radiating aperture and said third edge.

8. An antenna structure as set forth in claim 7, wherein said width of each of said apertures has a value that is equal to approximately 15% to approximately 40% less than a width of said electrically conductive layer, and wherein each of said apertures is located from said third edge at distance that is approximately equal to said length of said aperture.

9. An antenna structure as set forth in claim 7, wherein said shorting means is comprised of one of a continuous short circuit means, a partial short circuit means, and a plurality of electrically conductive feed throughs that pass through said dielectric layer between said ground plane and said electrically conductive layer.

10. An antenna structure as set forth in claim 7, wherein said coupling means is comprised of means for connecting a coaxial cable to said electrically conductive layer of said driven antenna element at a point between said aperture and said third edge.

11. An antenna structure as set forth in claim 7, wherein said ground plane is truncated, and has dimensions that are approximately equal to the total dimensions of said driven element and said non-driven, parasitic elements.

12. An antenna structure as set forth in claim 7, wherein said structure is curved about at least one axis.

13. A module adapted for insertion into a data processor, said module comprising:

an interface for electrically coupling said module to the data processor;

a modem that is bidirectionally coupled to said interface;

an RF energy transmitter having an input coupled to an output of said modem;

an RF energy receiver having an output coupled to an input of said modem; and a wide band, shorted, dual C-patch antenna that is electrically coupled to an output of said RF energy transmitter and to an input of said RF energy receiver, said antenna being comprised of a plurality of antenna elements including a driven, shorted, dual C-patch antenna element and at least one non-driven, parasitic antenna element that is coupled to said driven shorted, dual C-patch antenna element across a gap, wherein said shorted, dual C-patch antenna is comprised of, a ground plane;

a layer of dielectric material having a first surface overlying said ground plane and an opposing second surface;

an electrically conductive layer overlying said second opposing surface of said dielectric layer, said electrically conductive layer being differentiated into said plurality of antenna elements including said driven antenna element and said at least one non-driven, parasitic antenna element, each of said antenna elements being in the shape of a parallelogram and having one of a rectangular and a non-rectangular aperture having a length that extends along a first edge of said electrically conductive layer and a width that extends towards an oppositely disposed second edge;

each of said antenna elements including means for shorting said electrically conductive layer to said ground plane at a region adjacent to a third edge of said electrically conductive layer; and means for coupling said electrically conductive layer of said driven antenna element to said output of said transmitter and to said input of said receiver, said coupling means being located between said radiating aperture and said third edge.

14. A module as set forth in claim 13, wherein said length of said aperture has a value that is equal to approximately 20% to approximately 35% of a length of said first edge, and wherein said width of said aperture has a value that is equal to approximately 15% to approximately 40% less than a width of said electrically conductive layer, and wherein said aperture is located from said third edge at distance that is approximately equal to said length of said aperture.

15. A module as set forth in claim 13, wherein said shorting means is comprised of a plurality of electrically conductive feedthroughs that pass through said dielectric layer between said ground plane and said electrically conductive layer.

16. A module as set forth in claim 13, wherein said shorting means is comprised of a length of electrically conductive material that extends from said ground plane to said electrically conductive layer.

17. A module as set forth in claim 13, wherein said coupling means is comprised of means for connecting a coaxial cable to said electrically conductive layer at a point between said aperture and said third edge.

18. A module as set forth in claim 13, wherein said length of said first edge is less than approximately 8.5 cm, and wherein said third edge has a length that is less than approximately 5.5 cm.

19. A module as set forth in claim 13, wherein said ground plane is truncated, and has dimensions that are approximately equal to the total dimensions of said driven element and said non-driven, parasitic elements.

20. A module as set forth in claim 13, wherein said module has dimensions of approximately 8.5 cm×5.4 cm by 0.5 cm.

21. A module as set forth in claim 13, wherein said wide bandwidth shorted, dual C-patch antenna has a resonant frequency of approximately 900 MHz.

22. A portable handset of a radiotelephone, said handset comprising:

an RF energy transmitter;

an RF energy receiver; and a wide bandwidth, shorted, microstrip antenna that is electrically coupled to an output of said RF energy transmitter and to an input of said RF energy receiver, said antenna being comprised of a plurality of antenna elements including a driven, shorted, dual C-patch antenna element and at least one non-driven, parasitic antenna element that is coupled to said driven, shorted, dual C-patch antenna element across a gap, wherein said shorted, dual C-patch antenna is comprised of, a ground plane;

a layer of dielectric material having a first surface overlying said ground plane and an opposing second surface;

an electrically conductive layer overlying said second opposing surface of said dielectric layer, said electrically conductive layer being differentiated into said plurality of antenna elements including said driven antenna element and said at least one non-driven, parasitic antenna element, each of said antenna elements being in the shape of a parallelogram and having one of a rectangular and a non-rectangular aperture having a length that extends along a first edge of said electrically conductive layer and a width that extends towards an oppositely disposed second edge;

each of said antenna elements including means for shorting said electrically conductive layer to said ground plane at a region adjacent to a third edge of said electrically conductive layer; and means for coupling said electrically conductive layer of said driven antenna element to said output of said transmitter and to said input of said receiver, said coupling means being located between said radiating aperture and said third edge.

23. A handset as set forth in claim 22, wherein said length of said aperture has a value that is equal to approximately 20% to approximately 35% of a length of said first edge, and wherein said width of said aperture has a value that is equal to approximately 15% to approximately 40% less than a width of said electrically conductive layer, and wherein said aperture is located from said third edge at distance that is approximately equal to said length of said aperture.

24. A handset as set forth in claim 22, wherein said shorting means is comprised of a plurality of electrically conductive feedthroughs that pass through said dielectric layer between said ground plane and said electrically conductive layer.

25. A handset as set forth in claim 22, wherein said shorting means is comprised of a length of electrically conductive material that extends from said ground plane to said electrically conductive layer.

26. A handset as set forth in claim 22, wherein said coupling means is comprised of means for connecting a coaxial cable to said electrically conductive layer at a point between said aperture and said third edge.

27. A handset as set forth in claim 22, wherein said length of said first edge is less than approximately 8.5 cm, and wherein said third edge has a length that is less than approximately 5.5 cm.

28. A handset as set forth in claim 22, wherein said ground plane is truncated, and has dimensions that are approximately equal to the total dimensions of said driven element and said non-driven, parasitic elements.

29. A portable handset of a radiotelephone, said handset comprising:

an RF energy transmitter;

an RF energy receiver; and a wide bandwidth, shorted, microstrip antenna that is electrically coupled to an output of said RF energy transmitter and to an input of said RF energy receiver, said antenna being comprised of a plurality of antenna elements including a driven, shorted, dual C-patch antenna element and at least one non-driven, parasitic antenna element that is coupled to said driven, shorted, dual C-patch antenna element across a gap;

said portable handset operating in cooperation with a base station comprising a base station RF energy transmitter and a base station RF energy receiver capable of wireless, bidirectional communication with said handset, wherein said base station is comprised of a second, wide bandwidth, shorted, microstrip antenna that is electrically coupled to an output of said base station RF energy transmitter and to an input of said base station RF energy receiver, said second wide bandwidth, shorted, microstrip antenna being comprised of a driven antenna element and at least one non-driven, parasitic antenna element.

30. A handset as set forth in claim 22, wherein said wide bandwidth, shorted, microstrip antenna has a resonant frequency of approximately 900 MHz.

* * * * *